US005490395A

United States Patent [19]

Williams et al.

[11] Patent Number: 5,490,395

[45] Date of Patent: Feb. 13, 1996

[54] AIR BAFFLE FOR A REFRIGERATOR

[75] Inventors: Stephen G. Williams, Ohio Township, Warrick County; Ronald W. Guess; Lori A. Cook, both of Scott Township, Vanderburgh County, all of Ind.

[73] Assignee: Whirlpool Corporation, Benton Harbor, Mich.

[21] Appl. No.: 342,972

[22] Filed: Nov. 21, 1994

[51] Int. Cl.[6] ..... F25D 17/04

[52] U.S. Cl. ..... 62/187; 137/625.3; 454/298

[58] Field of Search ..... 62/187; 137/625.3, 137/625.33; 251/251; 454/298, 324, 334

[56] References Cited

U.S. PATENT DOCUMENTS

| | | | |
|---|---|---|---|
| 3,441,082 | 4/1969 | Fragnito et al. | 454/334 X |
| 4,030,518 | 6/1977 | Wilcox | 251/251 X |
| 4,282,720 | 8/1981 | Stottmann et al. | 62/180 |
| 4,688,393 | 8/1987 | Linstromberg et al. | 62/187 |
| 4,903,501 | 2/1990 | Harl | 62/187 |
| 4,920,758 | 5/1990 | Janke et al. | 62/187 |
| 4,924,680 | 5/1990 | Janke et al. | 62/187 |
| 5,018,364 | 5/1991 | Chesnut et al. | 62/187 |

*Primary Examiner*—William E. Tapolcai
*Attorney, Agent, or Firm*—Thomas J. Roth; Joel M. Van Winkle

[57] ABSTRACT

A refrigerator having a cabinet defining a first compartment and a second compartment separated from each other by a divider wall wherein the divider wall has an air passage for communicating between the first and second compartments. A baffle is positioned within the air passage and is positionable in an open or closed position for selectively opening and closing the air passage. A motor drives a cam which is coupled to the baffle such that rotation of the cam operates to selectively move the baffle to the open or closed position. A thermostat senses temperature within the fresh food compartment. First and second switches selectively energize the motor such that the baffle may be opened when the thermostat indicates the fresh food compartment requires cooling and closed when the thermostat indicates the fresh food compartment does not require cooling, respectively. The baffle of the present invention further includes a first plate having an aperture therethrough defining an opening through which refrigerated air may pass, and a second plate movable relative to the first plate and including an aperture therethrough defining an opening through which refrigerated air may pass. Both the second plate and first plate aperture includes chamfered edges for forming a sharp edge periphery on the facing plate surfaces such that frost build up on the baffle may be removed by the chamfered edges provided on the periphery of the apertures.

17 Claims, 5 Drawing Sheets

AIR BAFFLE FOR A REFRIGERATOR

BACKGROUND OF THE INVENTION

This invention relates generally to refrigerator air circulation systems, and more particularly to a motorized air baffle for controlling the flow of air within a fresh food compartment of a refrigerator.

Conventional dual compartment refrigerators of the forced air circulation type utilize a single evaporator and an evaporator fan for cooling a freezer compartment thereof. The freezer compartment is coupled by a plurality of air passages through a divider wall to a fresh food compartment. An air baffle is located within the fresh food compartment air inlet passage wherein the baffle is operable to control the passage of refrigerated air into the fresh food compartment. In such a conventional refrigerator, if the refrigeration unit is operating, then the evaporator fan forces air flow across the evaporator coils and out the top of the freezer into a scoop which directs air to the fresh food compartment, past the baffle.

Typically, the baffle is manually adjustable for determining the proportional flow of air into the fresh food compartment during the freezer cooling cycle. However, various systems have been provided for automatically operating the baffle for providing improved control over the fresh food compartment temperature.

U.S. Pat. No. 4,924,680, to Janke et al., discloses a controllable baffle for a refrigeration apparatus. The baffle includes a fixed plate and a movable plate each having corresponding apertures therethrough for permitting the control of air flow to a fresh food compartment. The movable plate is slidably mounted to the fixed plate permitting straight line reciprocal motion of the movable plate with respect to the fixed plate. A solenoid actuator is provided for driving the movable plate.

U.S. Pat. No. 4,282,720, to Stottmann et al., discloses a refrigerator fan control for a refrigerator. This reference shows a rotatable air valve or baffle. The valve rotates between its open and closed positions of 90° by a solenoid that is momentarily energized. The energization of the solenoid effectively rotates the valve 45° in each direction of its armature reciprocal movement.

U.S. Pat. No. 4,920,758, to Janke et al., discloses an air circulation system for a refrigeration apparatus having a controllable baffle for selectively opening or closing dual output ports. The baffle includes a rotatable disk having open portions and closed portions. A motor is coupled to the disk for selectively rotating the disk so that its respective open portions are in selective alignment or disalignment with the dual output ports such that air circulation within the refrigerator is controlled.

One problem with all of the baffle systems as described above is that moisture can accumulate on the baffle during a defrost cycle. The amount of moisture depends in part on the ambient humidity. Colder air from the evaporator coils can cause any moisture accumulated on the baffle to freeze. The resulting ice prevents free movement of the baffle which may result in undesirable effects such as overcooling of the fresh food compartment.

U.S. Pat. No. 4,903,501, to Harl, discloses a controllable baffle for a refrigeration apparatus wherein means are provided for preventing freeze up of the baffle. The baffle includes a fixed plate and a movable plate each having corresponding apertures therethrough for permitting the control of air flow to a fresh food compartment. The fixed plate is provided with a heating device molded therein which is operable to maintain the fixed plate above the freezing temperature to prevent moisture from freezing thereon. Additionally, spacer means are provided for maintaining the movable plate in spaced relation with the fixed plate for minimizing moisture which may bridge between the plates and freezer. A solenoid actuator is provided for driving the movable plate..

SUMMARY OF THE INVENTION

Accordingly, one object of the present invention is to provide a system for controlling the air circulation within the fresh food compartment.

Another object is to provide a system for selectively positioning a baffle in a fully open position or a fully closed position.

Still another object of the present invention is to provide a simple electro-mechanical system control system for opening and closing a motor driven longitudinally slidable baffle.

Still another object is to provide a baffle having means for removing frost build up on the baffle such that the baffle operation is not impaired by frost.

According to the present invention, the foregoing and other objects are attained by a refrigerator having a cabinet defining a first freezer compartment and a second fresh food compartment separated from each other by a divider wall wherein the divider wall has an air passage for communicating between the first and second compartments. The refrigerator further includes an evaporator disposed in the first compartment, a compressor fluidly connected with the evaporator for moving refrigerant therethrough, and an evaporator fan for moving air over the evaporator. A baffle is positioned within the air passage and is positionable in an open or closed position for selectively opening and closing the air passage. A motor drives a cam which is coupled to the - - - drives a cam which is coupled to the baffle such that rotation of the cam operates to selectively move the baffle to the open or closed position. A thermostat senses temperature within the fresh food compartment. A first switch is operatively associated with the cam for selectively energizing the motor such that the baffle may be moved from the closed position to the open position when the thermostat indicates the fresh food requires cooling. A second switch is operatively associated with the cam for selectively energizing the motor such that the baffle may be moved from the open position to the closed position when the thermostat indicates the fresh food compartment does not require cooling.

A second thermostat senses temperature within the freezer compartment. An evaporator fan and baffle control system is provided including a switch which is operatively associated with the cam for connecting the second thermostat and the evaporator fan in series with a power supply when the baffle is in the closed position and for further connecting the fresh food compartment thermostat and the evaporator fan in series with the power supply when the baffle is in the open position.

The baffle of the present invention further includes a first plate having an aperture therethrough defining an opening through which refrigerated air may pass, and a second plate movable relative to the first plate and including an aperture therethrough defining an opening through which refrigerated air may pass. The cam operates to move the second plate relative to the first plate to position the openings in a preselected alignment to control the movement of refrigerated air through the passage. The second plate aperture has chamfered edges for forming a sharp edge periphery on the second plate surface facing the first plate such that frost build up on the first plate may be removed by the chamfered edges of the second plate aperture during movement of the second plate relative to the first plate. Likewise, the first plate aperture has chamfered edges for forming a sharp edge periphery on the first plate surface facing the second plate such that frost build up on the second plate may be removed by the chamfered edges of the first plate aperture during movement of the second plate relative to the first plate.

DETAILED DESCRIPTION OF THE PREFERRED EMBODIMENTS

Figure 1:
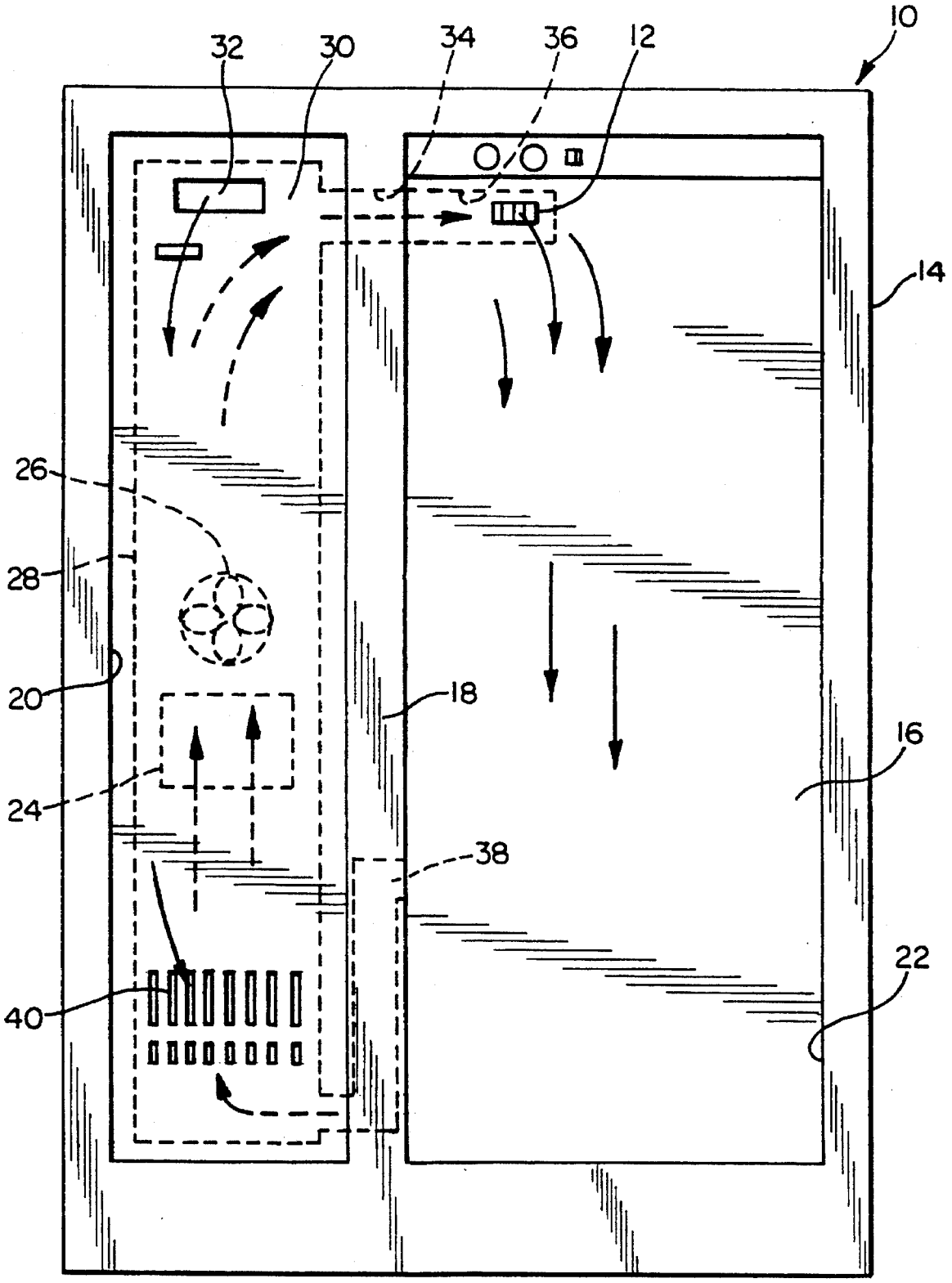
FIG. 1 is a front elevational view of a refrigerator having an air baffle embodying the invention, the compartment doors being omitted to facilitate an illustration of the components therein.

Referring to FIG. 1, a refrigeration apparatus, such as a refrigerator/freezer 10, includes an air baffle 12 according to the present invention. The invention is shown utilized with a side-by-side refrigerator/freezer. However, other types of refrigeration apparatus may be used in conjunction with the air baffle 12 of the present invention, as will be obvious to those skilled in the art.

The refrigerator/freezer 10 includes cabinet 14 housing a conventional liner 16 therein, with suitable insulation provided between the liner 16 and the cabinet 14. The liner 16 includes a plurality of wall portions, as is well known, and may be of one piece construction or of multiple piece construction, as necessary or desired. The refrigerator/freezer 10 includes an insulating separator or divider wall 18 which may utilize the liner wall portions. The cabinet 14, liner 16 and divider wall 18 together define a below-freezing, or freezer, compartment 20 and a fresh food, or above-freezing, compartment 22. Suitable doors (not shown) are provided for selective access to the freezer and fresh food compartments 20 and 22.

The freezer and fresh food compartments 20 and 22 are cooled by circulating refrigerated air therethrough which has been refrigerated as a result of being passed in heat exchange relation with a conventional evaporator 24. An evaporator fan 26 draws air across the evaporator 24 with the cooled air passing through a duct 28 behind a rear wall 30 of the freezer compartment 20 and further through a freezer compartment air inlet 32. The duct 28 is also in communication with a scoop, or passage 34, in the separator 18. The passage 34 is in communication with an air duct 36 in the upper rear section of the fresh food compartment 22, which duct 36 includes a fresh food compartment air inlet opening (not shown). The selectively positionable baffle 12 overlies the air inlet opening and is operated by a control described below to control the passage of refrigerated air into the fresh food compartment 22. The passage 34, the duct 36 and the opening collectively define an air inlet passageway.

Although the baffle 12 is illustrated overlying the air inlet opening, the baffle 12 could be disposed at various positions within the passage 34 or the duct 36 as is obvious to those skilled in the art.

Refrigerated air that passes through the passage 34 is discharged through air inlets of the baffle 12 to circulate within the fresh food compartment 22 and subsequently return to the freezer duct 28 through a return air outlet duct, or passage 38 located in the separator 14 at the bottom rear of the fresh food compartment 22.

The refrigerated air in the freezer compartment 20 returns to the duct 28 at a freezer compartment air outlet 40 and mixes with the air returned from the fresh food compartment 22. The mixed air is drawn by the evaporator fan 26 across the evaporator 24 during a cooling unit on cycle to remove heat therefrom and recirculate the air in the compartments 20 and 22.

Figure 8:
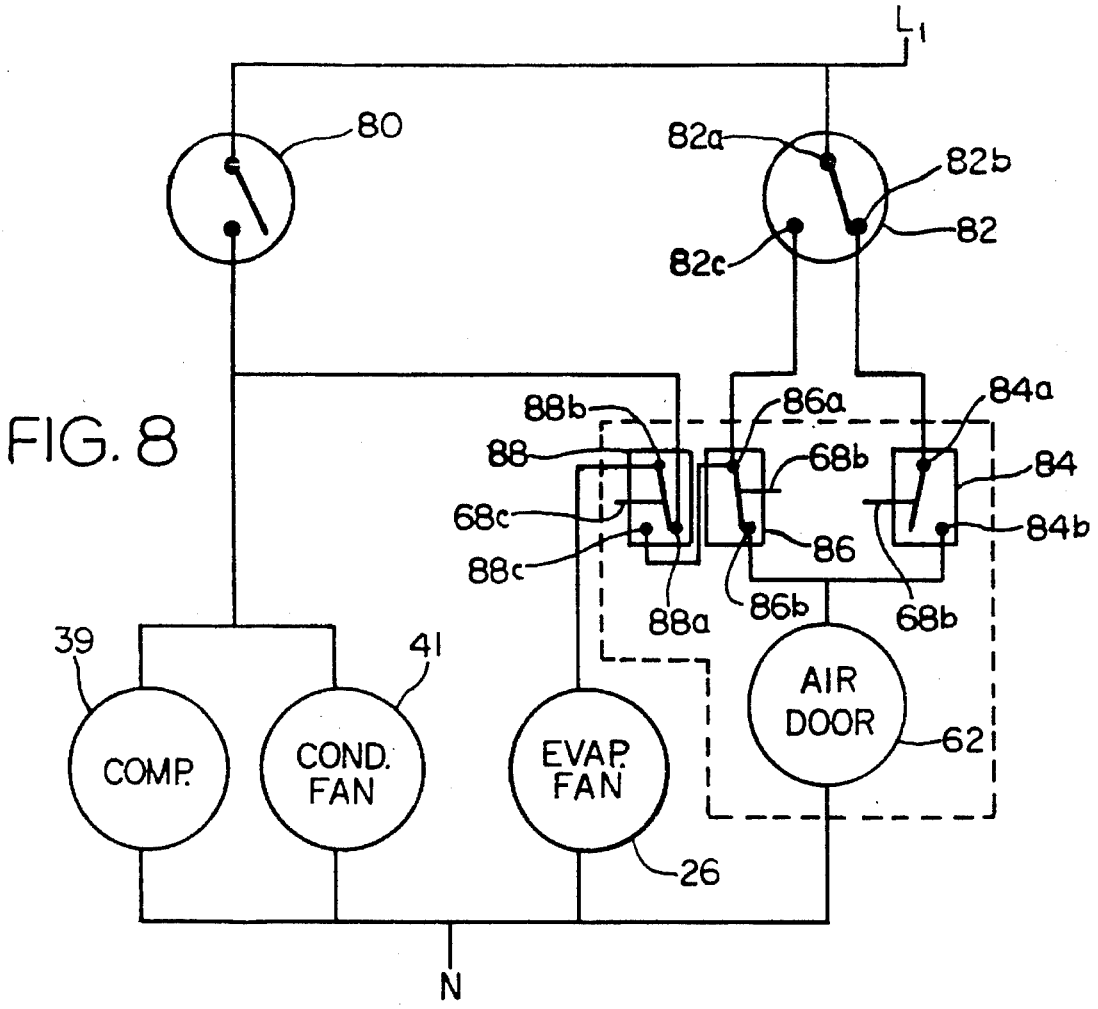
FIG. 8 is an electrical schematic of an evaporator fan and baffle control system of the present invention, wherein the baffle is positioned in a closed position.

In addition to the evaporator 24 and the evaporator fan 26, the refrigeration apparatus 10 includes connected components such as a compressor 39 and a condenser fan, shown in FIG. 8, and a condenser and a defrost heater, not shown, as is well known.

Figure 2:
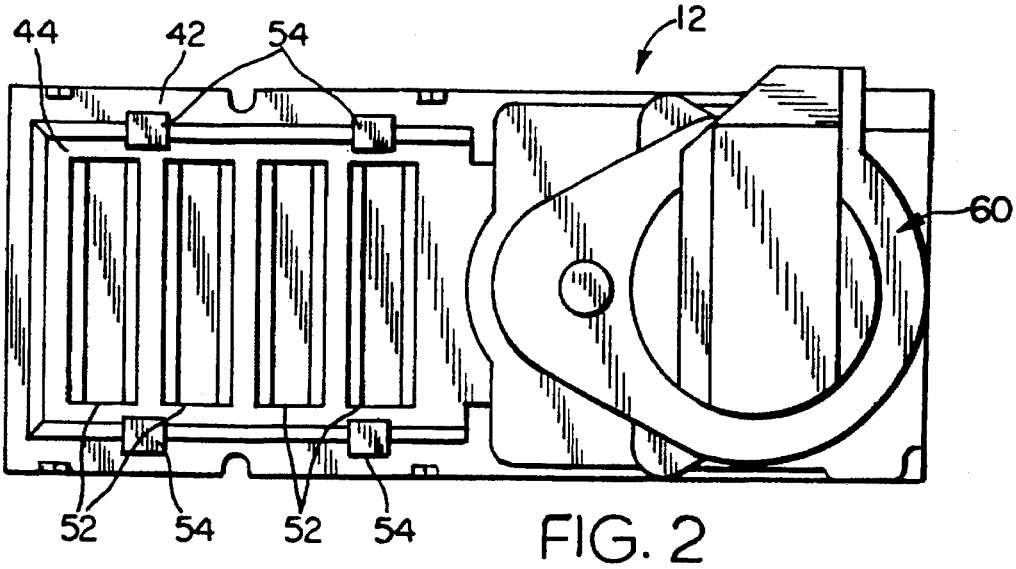
FIG. 2 is a plan view of a baffle system according to the invention.
Figure 3:
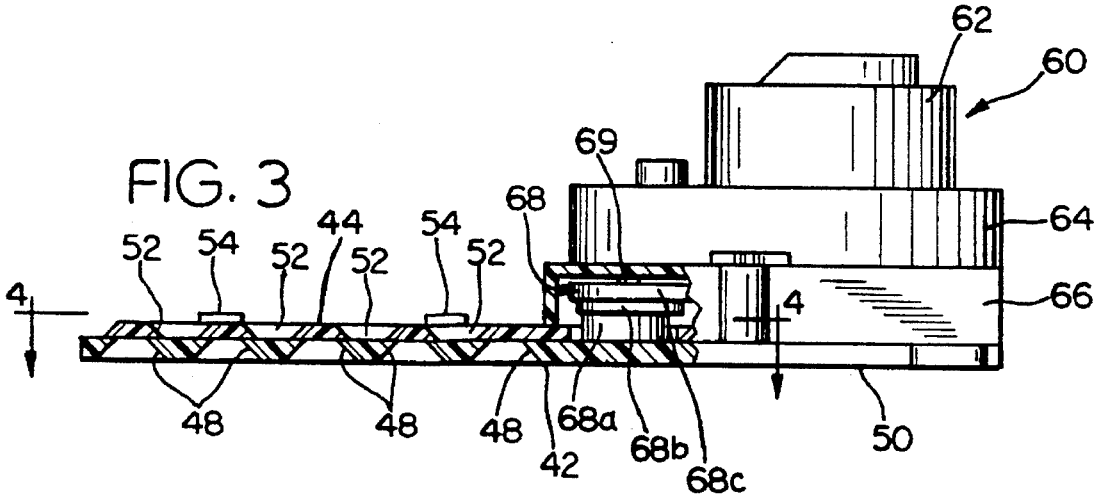
FIG. 3 is a partly cut away side elevational view of the baffle of FIG. 2.

Referring to FIGS. 2 and 3, the baffle 12 can be seen to include a fixed plate 42 and a slide plate 44.

The fixed plate 42 is of one-piece molded plastic construction and is generally rectangular shaped. The fixed plate 42 includes a plurality of longitudinally spaced, laterally extending apertures 48 therethrough. The apertures 48 are provided for enabling refrigerated air to enter the fresh food compartment 22. An actuator mounting end 50 of the fixed plate 42 includes no such apertures 48.

The slide plate 44 is also of generally rectangular construction, but is of smaller size than the fixed plate 42. The slide plate 44 includes a plurality of apertures 52 therethrough corresponding to the apertures 48 in the fixed plate 42.

The slide plate 44 is slidably mounted to the fixed plate 42 permitting straight line reciprocal motion of the slide plate 44 with respect to the fixed plate 42. Specifically, the fixed plate 42 includes a plurality of outwardly extending L-shaped slide members 54 for laterally constraining the slide plate 44 with respect to the fixed plate 42 while allowing longitudinal movement. The L-shaped members 54 are laterally spaced apart a distance slightly greater than the width of the slide plate 44 and define a track within which the movable plate 44 can slide. It can be understood, therefore, that the slide plate 44 is slidably movable relative to the fixed plate 42 between an open position, with its apertures 52 in alignment with the fixed plate apertures 48 to permit refrigerated air to flow into the fresh food compartment, and a closed position wherein the apertures 48 and 52 are in disalignment to prevent the refrigerated air from entering the fresh food compartment 22.

Mounted to the fixed plate 42 is a slide plate drive system 60 including a motor 62, a gear reduction mechanism 64 and a cam 68. The motor is mounted to the gear reduction mechanism which operates in a known manner to reduce the motor speed output. The gear reduction mechanism 64 is mounted to a housing 66 which is mounted to the fixed plate 42. The cam member 68, disposed within the housing 66, is interconnected with the gear reduction drive output 69 and includes a first, second and third control surfaces, 68*a*, 68*b* and 68*c*, respectively.

Figure 4:
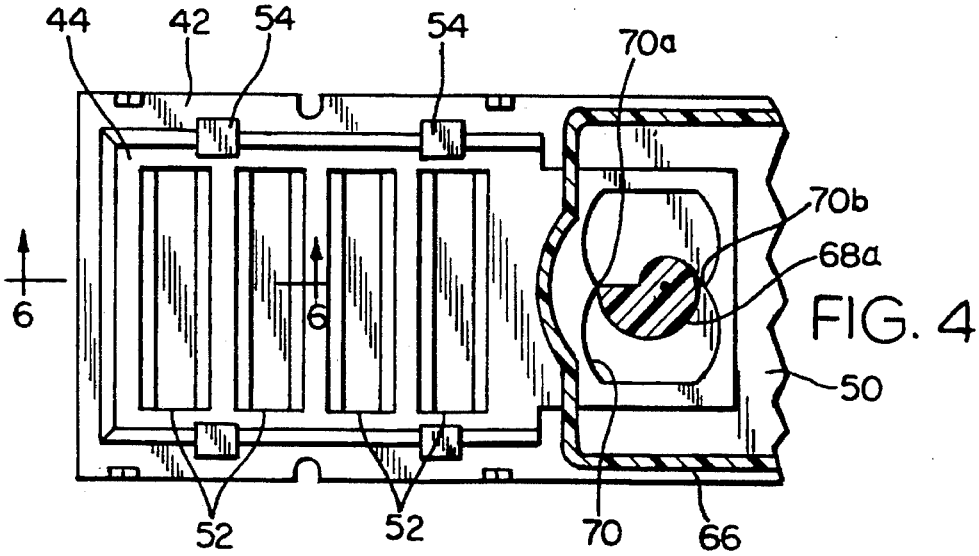
FIG. 4 is a view taken along lines 4—4 of FIG. 2 showing the baffle in a closed position.
Figure 5:
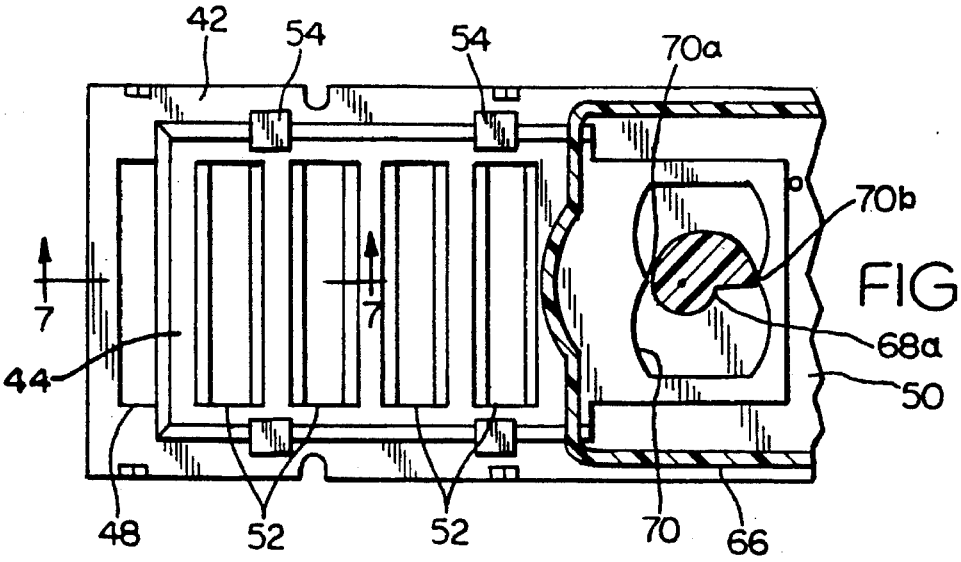
FIG. 5 is a view taken along lines 4—4 of FIG. 2 showing the baffle in an open position.

As shown in FIGS. 4 and 5, the cam 68 operates to drive the slide plate such that the baffle may be selectively positioned in the closed or open position. The first surface 68*a* of the cam 68 is disposed within a shaped slot 70 provided on slide plate 44. The shaped slot 70 includes a first contact point 70*a* and a second contact point 70*b*. In operation, rotation of the cam 68 causes the first control surface 68*a* to engage either the first or second contact point 70*a* or 70*b*, respectively, for moving the slide plate 44 relative to the fixed plate 42. As shown in FIG. 4, the first control surface 68*a* is positioned such that the slide plate is in a closed position. In FIG. 5, the cam 68 is shown rotated 180 angular degrees from FIG. 4, whereby the first control surface 68*a* has engaged the second contact point 70*b* for moving the slide plate 44 to an open position.

Figure 6:
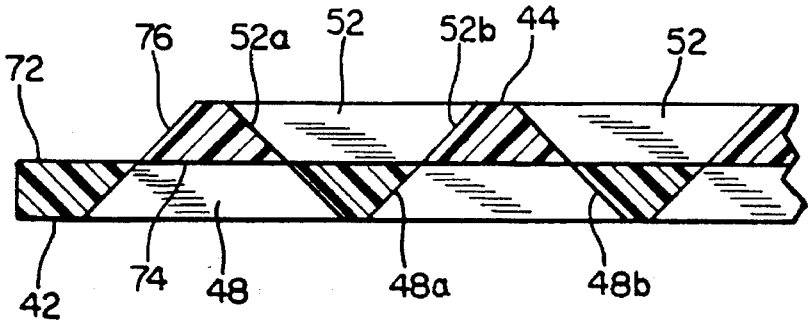
FIG. 6 is an enlarged sectional view taken along lines 6—6 in FIG. 4.
Figure 7:
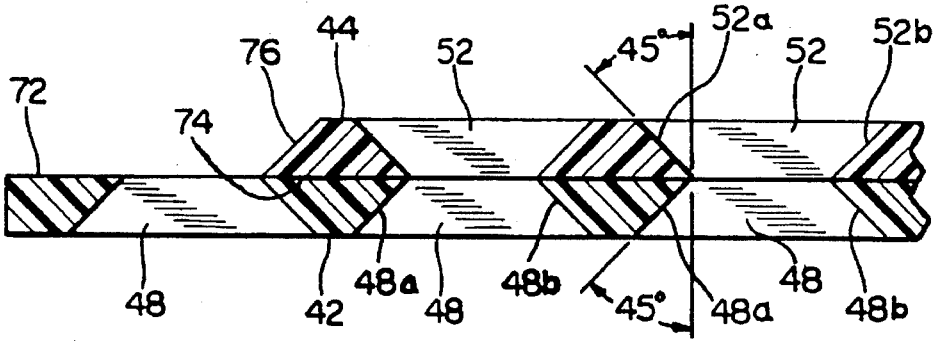
FIG. 7 is an enlarged sectional view taken along lines 7—7 in FIG. 5.

Turning now to FIGS. 6 and 7, details of the fixed plate and the slide plate 44 are shown. As described above, the slide plate 44 is slidably mounted to the fixed plate 42 wherein a top surface 72 of the fixed plate and a bottom surface 74 of the slide plate 44 are slidably disposed adjacent each other. As can be readily understood by one skilled in the art, for the baffle 12 to effectively prevent air flow through the duct 34 when the slide plate 44 is in the closed position, the top surface 72 and the bottom surface 74 must substantially contact each other to provide a seal between the slide plate 44 and fixed plate 42. To this end, the top surface 72 and the bottom surface 74 are preferably flat to within 0.25 mm such that the gap between the two surfaces, 72 and 74, may be limited to no more than 0.15 mm.

This intimate contact between the top surface 72 and the bottom surface 74, however, may contribute to frost forming on the baffle 12 and bridging between the fixed plate 42 and slide plate 44, thereby inhibiting the movement of the slide plate 44 relative to the fixed plate 42. To overcome this problem, the front edge 76 of the slide plate 44 as well as the side edges 52*a* and 52*b* of the slide plate apertures 52 and the side edges 48*a* and 48*b* of the fixed plate apertures 48 are chamfered such that the respective edges provide a structure for removing frost which may accumulate on the baffle. These edges operate to remove frost in both directions of slide plate movement. Preferably, each of these edges, 76, 52*a*, 52*b*, 48*a* and 48*b*, respectively, is provided with a 45 degree chamfer such that each edge presents a sharp edge for contacting the facing plate and a 45 degree slope for forcing away frost build up.

In FIGS. 8–11, a unique and simple evaporator fan control system and baffle control system of the present invention are shown. The evaporator control system is such that evaporator fan 26 may be energized when either the fresh food compartment 22 or the freezer compartment 20 require cooling. The baffle door control system is such that when the fresh food compartment requires cooling, the baffle 12 is open. However, when cooling of the fresh food compartment is not required, the baffle 12 is closed.

Turning now to FIG. 8, a freezer thermostat 80 and a fresh food thermostat 82 are shown. As is known, the freezer thermostat 80 senses temperature in the freezer compartment 20 and the fresh food thermostat 82 senses temperature in the fresh food compartment 22.

The freezer thermostat is electrically connected in series with the compressor 39 and the condenser fan 41 such that when the freezer thermostat 80 is closed, indicating that freezer cooling is required, the compressor 39 and condenser fan 41 are energized. The fresh food thermostat is connected in series with the baffle motor 62 through a first switch 84 and a second switch 86 wherein the switches 84 and 86 are connected in parallel. Further, a third switch 88 is provided connected in series between the fresh food thermostat 82 and the evaporator fan 26. The third switch 88 is also connected in series between the freezer thermostat and the evaporator fan 26. All of the switches, 84, 86 and 88 respectively, are operated by the cam 68.

Figure 9:
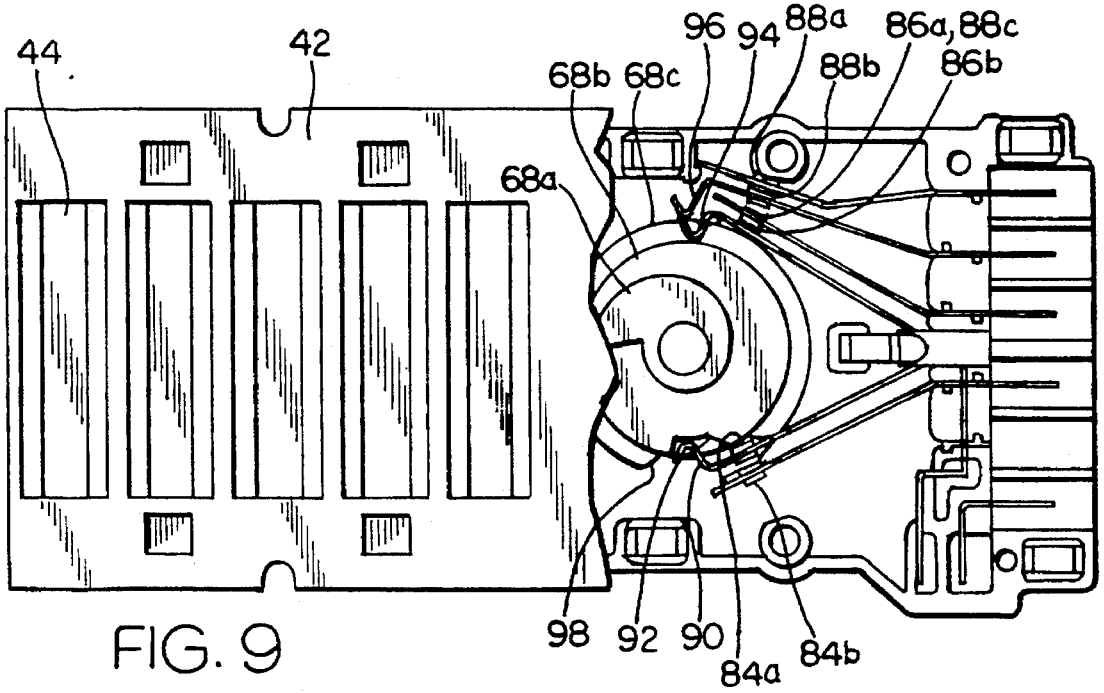
FIG. 9 is a partly cut away bottom elevational view of the baffle of FIG. 2 showing the baffle in a closed position.

In FIG. 9, the switches 84, 86 and 88 are shown assembled within the housing 66. As shown, the second control surface 68*b* engages a cam follower 90 for selectively operating the first switch 84. The second control surface 68*b* additionally engages a cam follower 94 for selectively operating the second switch 86. Further, the third control surface 68*c* engages a cam follower 96 for operating the third switch 88.

During operation, when the fresh food compartment is at or below the desired fresh food temperature, the fresh food thermostat is oriented in a position wherein a current path is provided through the contacts 82*a* and 82*b*. When the thermostat is oriented in this fashion, the baffle is positioned in a closed position, as shown in FIG. 9. It can be seen that in this condition, the cam follower 90 resides in a recess 92 provided on the second control surface 68*b* such that the contacts 84*a* and 84*b* are not engaged. Additionally, the cam follower 94 is engaged by the second control surface 68*b* such that switch 86 is closed wherein contacts 86*a* and 86*b* are engaged. Still further, the cam follower 96 is positioned by the third control surface 68*c* such that contacts 88*a* and 88*b* are engaged thereby connecting the evaporator fan in series with the freezer thermostat 80.

In the baffle closed condition, therefore, the freezer thermostat 80 controls the operating of the evaporator fan 26, the compressor 39, and the condenser fan 41 responsive to the cooling demands of the freezer compartment 20.

When the temperature in the fresh food compartment 22 rises above the desired fresh food temperature, the fresh food thermostat 82 opens contacts 82*a* and 82*b* and closes contacts 82*a* and 82*c*. Under this condition, the baffle motor 62 is energized through the second switch 86 which is in the closed position as described above. Energization of the motor 62 causes the cam 68 to rotate, closing the first switch 84 and moving the slide door 44 from a closed toward an open position. As further described above, 180 degree rotation of the cam 68 moves the baffle 12 from a completely closed position to a completely open position. In the completely open position, the recess 92 provided on the second control surface 68*b* operates to open the second switch 68, thereby deenergizing the motor 62. Further, the third control surface drives the third switch 88 to close contacts 88*c* and 88*b* wherein the evaporator fan 26 is energized through the fresh food thermostat 82.

Figure 10:
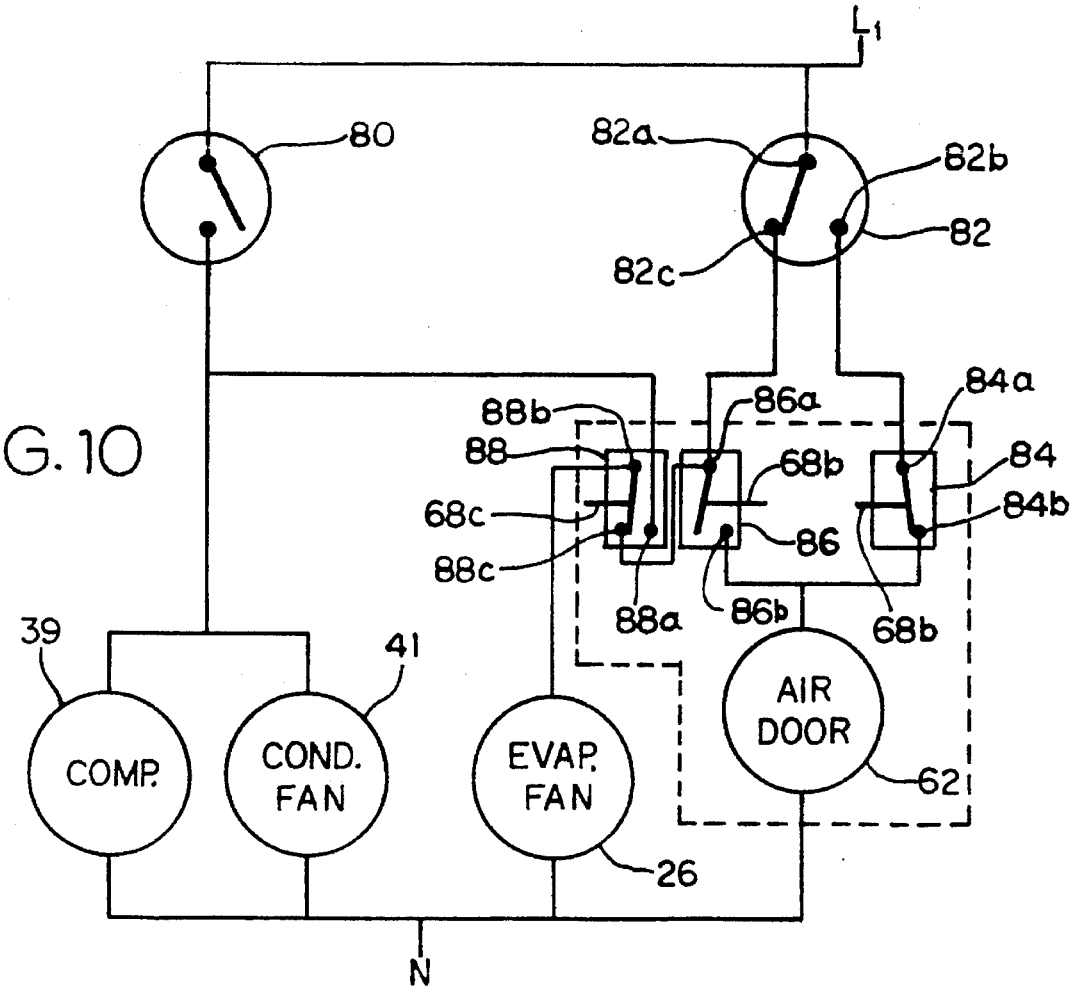
FIG. 10 is an electrical schematic of an evaporator fan and baffle control system of the present invention, wherein the baffle is positioned in an open position.
Figure 11:
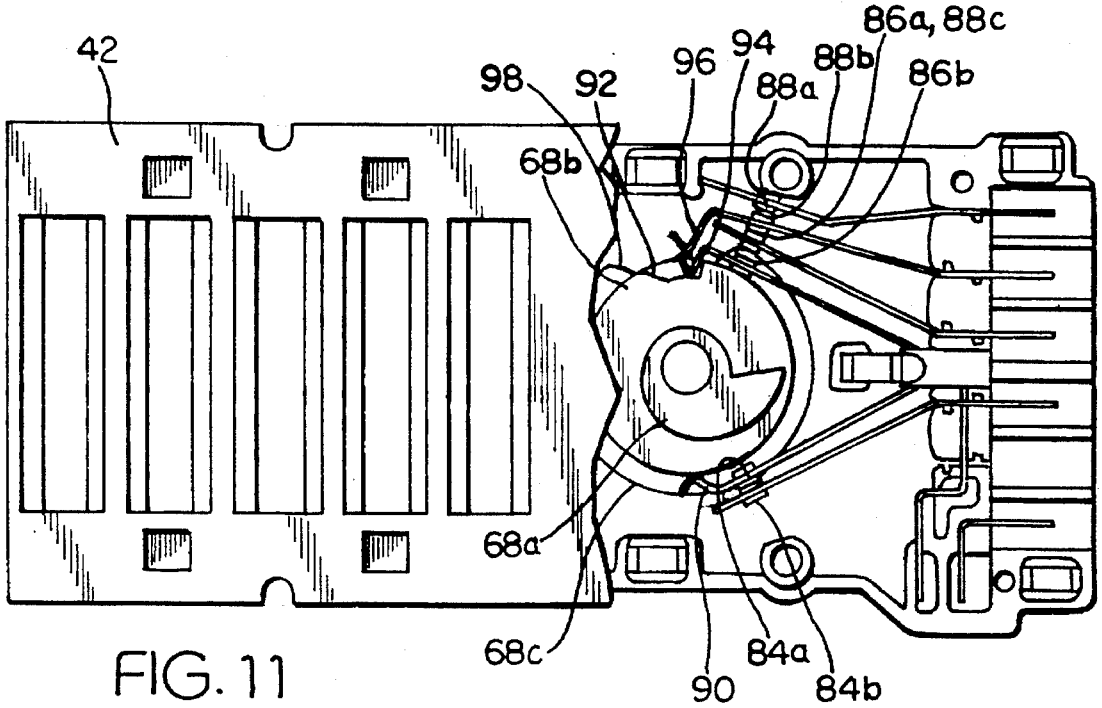
FIG. 11 is a partly cut away bottom elevational view of the baffle of FIG. 2 showing the baffle in an open position.

FIGS. 10 and 11, illustrate the switch configuration when the fresh food compartment 22 is calling for cooling and the baffle is in a completely open position. In this condition, the cam follower 90 is engaged by the second control surface 68*b* such that the first switch 84 is closed. The cam follower 94, however, resides in the recess 92 such that the second switch 86 is open. Further, the cam follower 96 resides in a recess 98 provided on the third control surface 68*c* such that the third switch 88 is oriented to close contacts 88*b* and 88*c*.

In the baffle open condition, therefore, the fresh food thermostat 82 controls the operation of the evaporator fan 26. As described above, when the fresh food thermostat calls for additional cooling for the fresh food compartment, the baffle 12 is positioned in an open position. It can be understood, therefore, that whenever the baffle 12 is open, the evaporator fan is energized.

When the temperature in the fresh food compartment 22 moves below the desired fresh food temperature, the fresh food thermostat 82 opens contacts 82*a* and 82*c* and closes contacts 82*a* and 82*b*. Under this condition, the baffle motor 62 is energized through the first switch 84 which is in the closed position. Energization of the motor 62 causes the cam 68 to rotate, closing the second switch 86 and moving the slide door 44 from an open toward a closed position. As described above, 180 degree rotation of the cam 68 moves the baffle 12 from a completely open position to a completely closed position. In the completely closed position, the recess 92 provided on the second control surface 68*b* operates to open the first switch 84, thereby deenergizing the motor 62. Further, the third control surface drives the third switch 88 to close contacts 88*a* and 88*b* wherein the evaporator fan 26 is energized through the freezer thermostat 80.

Although the present invention has been described with reference to specific embodiments, those of skill in the Art will recognize that changes may be made thereto without departing from the scope and spirit of the invention as set forth in the appended claims. Although a specific embodiment of our invention may be for use in a side-by-side refrigerator, it may be easily understood that this invention may be supplied in other refrigerator configurations.

We claim:

1. In a refrigerator having a cabinet defining a freezer compartment and a fresh food compartment separated from each other by a divider wall, the divider wall having an air passage for communicating between said compartments, said refrigerator further having an evaporator disposed in said freezer compartment, a compressor fluidly connected with said evaporator for moving refrigerant therethrough, and an evaporator fan for moving air over the evaporator wherein a power supply is selectively connected to said compressor and evaporator, a system for controlling fair circulation within the fresh food compartment comprising:

a baffle positioned within said air passage and being positionable in an open or closed position for selectively opening and closing said air passage;

a motor;

a cam drivingly interconnected with said motor and coupled to said baffle such that rotation of said cam operates to selectively move said baffle to said open or closed position;

a thermostat for sensing temperature within said fresh food compartment;

a first switch operatively associated with said cam for selectively connecting said motor with said power source such that said baffle may be move from said closed position to said open position when said thermostat indicates said fresh food compartment requires cooling; and a second switch operatively associated with said cam for selectively connecting said motor with said power source such that said baffle may be moved from said open position to said closed position when said thermostat indicates said fresh food compartment does not require cooling.

2. The system for controlling air circulation within the fresh food compartment according to claim 1, further comprising;

said cam further having a first control surface and a second control surface, said first control surface operating to position said baffle in said closed or open position, said second control surface operating to close said first switch when said baffle is in said closed position and to open said first switch when said baffle is in said open position, and said second control surface further operating to open said second switch when said baffle is in said closed position and to close said second switch when said baffle is in said open position.

3. The system for controlling air circulation within the fresh food compartment according to claim 1, further comprising:

a second thermostat for sensing temperature within said freezer compartment;

a third switch operatively associated with said baffle for connecting said second thermostat and said evaporator fan in series with said power supply when said baffle is in said closed position and connecting said fresh food compartment thermostat and said evaporator fan in series with said power supply when said baffle is in said open position.

4. The system for controlling air circulation within the fresh food compartment according to claim 3, further comprising:

said cam further having a third control surface, said third switch being operated by movement of said third control surface.

5. The system for controlling air circulation within the fresh food compartment according to claim 1, said baffle further comprising:

a first plate having an aperture therethrough defining an opening through which refrigerated air may pass; and a second plate movable relative to said first plate and including an aperture therethrough defining an opening through which refrigerated air may pass;

wherein said cam operates to move said second plate relative to said first plate to position said openings in a preselected alignment to control the movement of refrigerated air through said passage.

6. The system for controlling air circulation within the fresh food compartment according to claim 5, further wherein:

said second plate aperture has chamfered edges for forming a sharp edge periphery on the second plate surface facing said first plate such that frost build up on said first plate may be removed by said chamfered edges of said second plate aperture during movement of said second plate relative to said first plate.

7. The system for controlling air circulation within the fresh food compartment according to claim 6, further wherein:

said first plate aperture has chamfered edges for forming a sharp edge periphery on the first plate surface facing said second plate such that frost build up on said second plate may be removed by said chamfered edges of said first plate aperture during movement of said second plate relative to said first plate.

8. The system for controlling air circulation within the fresh food compartment according to claim 7, further wherein:

said chamfered edges of said first plate aperture and said second plate aperture comprise a 45° chamfer for forming said sharp edges and for providing a 45° slope to force frost build up away from the contacting plate surfaces.

9. The system for controlling air circulation within the fresh food compartment according to claim 7, further wherein:

said first plate and said second plate are formed such that the gap between said first plate and said second plate is less than 0.15 mm.

10. In a refrigerator having a cabinet defining a freezer compartment and a fresh food compartment separated from each other by a divider wall, the divider wall having an air passage for communicating between said compartments, said refrigerator further having an evaporator disposed in said freezer compartment, a compressor fluidly connected with said evaporator for moving refrigerant therethrough, and an evaporator fan for moving air over the evaporator wherein a power supply is selectively connected to said compressor and evaporator, a system for controlling air circulation within the fresh food compartment comprising:

a baffle positioned within said air passage and being positionable in an open or closed position for selectively opening and closing said air passage, said baffle further including:

a first plate having an aperture therethrough defining an opening through which refrigerated air may pass; and a second plate movable relative to said first plate and including an aperture therethrough defining an opening through which refrigerated air may pass, said second plate aperture having chamfered edges for forming a sharp edge periphery on the second plate surface facing said first plate such that frost build up on said first plate may be removed by said chamfered edges of said second plate apertures during movement of said second plate relative to said first plate, said second plate further having an outer periphery edge which is chamfered;

a motor; and a cam drivingly interconnected with said motor and coupled to said second plate of said baffle such that rotation of said cam operates to selectively move said second plate relative to said first plate to position said openings in a preselected alignment to control the movement of refrigerated air through said passage.

11. The system for controlling air circulation within the fresh food compartment according to claim 10, further comprising:

a thermostat for sensing temperature within said fresh food compartment;

a first switch operatively associated with said cam for selectively connecting said motor with said power source such that said baffle may be moved from said closed position to said open position when said thermostat indicates said fresh food compartment requires cooling; and a second switch operatively associated with said cam for selectively connecting said motor with said power source such that said baffle may be moved from said open position to said closed position when said thermostat indicates said fresh food compartment does not require cooling.

12. The system for controlling air circulation within the fresh food compartment according to claim 11, further comprising:

said cam further having a first control surface and a second control surface, said first control surface operating to position said baffle in said closed or open position, said second control surface operating to close said first switch when said baffle is in said closed position and to open said first switch when said baffle is in said open position, and said second control surface further operating to open said second switch when said baffle is in said closed position and to close said second switch when said baffle is in said open position.

13. The system for controlling air circulation within the fresh food compartment according to claim 11, further comprising:

a second thermostat for sensing temperature within said freezer compartment;

a third switch operatively associated with said baffle for connecting said second thermostat and said evaporator fan in series with said power supply when said baffle is in said closed position and connecting said fresh food compartment thermostat and said evaporator fan in series with said power supply when said baffle is in sand open position.

14. The system for controlling air circulation within the fresh food compartment according to claim 3, further wherein:

said cam further has a third control surface, said third switch being operated by movement of said third control surface.

15. The system for controlling air circulation within the fresh food compartment according to claim 10, further wherein:

said first plate aperture has chamfered edges for forming a sharp edge periphery on the first plate surface facing said second plate such that frost build up on said second plate may be removed by said chamfered edges of said first plate apertures during movement of said second plate relative to said first plate.

16. The system for controlling air circulation within the fresh food compartment according to claim 15, further wherein:

said chamfered edges of said first plate aperture and said second plate aperture comprise a 45° chamfer for forming said sharp edges and for providing a slope to force frost build up away from the contacting plate surfaces.

17. The system for controlling air circulation within the fresh food compartment according to claim 16, further wherein:

said first plate and said second plate are formed such that the gap between said first plate and said second plate is less than 0.15 mm.

* * * * *